US005817379A

United States Patent [19]

Rich et al.

[11] Patent Number: 5,817,379

[45] Date of Patent: Oct. 6, 1998

[54] DOUBLE SIDED TOWEL WITH AN IMPERMEABLE MATERIAL LINED POCKET

[76] Inventors: Jennifer Rich; Greg Funderburk, both of 4932 Park Dr., Carlsbad, Calif. 92008

[21] Appl. No.: 852,134

[22] Filed: May 6, 1997

[51] Int. Cl.[6] ..... B65D 30/02

[52] U.S. Cl. ..... 428/35.2; 206/315.5; 383/4; 428/100

[58] Field of Search ..... 383/4, 109; 428/35.2, 428/99, 100; 206/315.5

[56] References Cited

U.S. PATENT DOCUMENTS

| | | | |
|---|---|---|---|
| 3,052,895 | 9/1962 | Lo Vico | 383/4 X |
| 3,342,613 | 9/1967 | Schelhorn | 428/511 X |
| 4,856,912 | 8/1989 | Damus et al. | 428/100 X |
| 5,110,219 | 5/1992 | Lopes | 383/4 |
| 5,318,821 | 6/1994 | Bradley, Jr. | 428/35.2 X |

*Primary Examiner*—Henry F. Epstein
*Attorney, Agent, or Firm*—Gilliam, Duncan, Harms

[57] ABSTRACT

A two-sided towel for wiping moisture from two different surfaces while preventing cross contamination of the moisture between the surfaces. Coextensive first and second sheets, each having a moisture absorbent side and a moisture impervious side are fastened together with the moisture impervious sides abutting. The edges of the resulting sandwich are fastened together while leaving at least a portion of one edge unfastened, forming a pocket between the sheets into which a hand can be inserted. Typically, the towel is used by a fitness center patron to wipe perspiration from his or her body with one side and wipe moisture and dirt from equipment with the other side. The towel can also have fasteners to releasably close the opening so that it can be used as a bag, or be turned inside out and closed to carry damp clothing inside.

16 Claims, 1 Drawing Sheet

DOUBLE SIDED TOWEL WITH AN IMPERMEABLE MATERIAL LINED POCKET

FIELD OF THE INVENTION

This invention relates to towels for wiping perspiration from the body and moisture from equipment, in particular from exercise equipment in fitness centers and the like.

BACKGROUND OF THE INVENTION

When using exercise equipment in fitness centers, gymnasiums, etc., users tend to perspire heavily, with perspiration often transferring to the equipment. Towels are generally used for wiping perspiration from one's body and for wiping moisture, dirt and the like from the equipment. Using the same towel surface for both purposes is generally undesirable. Exercise equipment that has just been used by someone else generally is wet with that person's perspiration. Dirt on the machine, machine oil, etc. may be dissolved in that perspiration. The machine surfaces, typically handles, foot pads and body cushions, may be slippery and dangerous. A normally fastidious person will not enjoy wiping his or her own body with a towel that has been used to wipe such wet machine surfaces. Opposite sides of a towel could be used for these two different purposes. However, moisture will tend to soak through the towel, so that moisture wiped with either side will rapidly contaminate the other side. Even if one were to insert an impervious layer between the two towel sides, when the towel is used for wiping machine surfaces, the users hand will be on the personal perspiration side and when wiping the person's body the user's hand will be on the side tainted with moisture and dirt from the machine surfaces. Cross contamination of the hand and then from the hand to both towel sides will quickly result. In some cases, the two sides of a cleaning cloth should have different fabrics, one optimized for wiping away one type of surface contamination and the other optimized for cleaning dirt from a machine surface, such as is described by Maedo in Japanese patent No. 405192284. However this type of cloth or towel would still have the cross contamination and soak through problems when used for removing moisture as detailed above.

Two different towels could be used for these two different purposes. However, the towels can be easily mixed so that one inadvertently wipes his or her body with a towel contaminated with another's perspiration, dirt and machine oil. And, as one switches towels, both types of moisture will transfer from the user's hand to both towels. Even if the towels bear different indicia or have different colors, one may pick up and use the wrong towel. Keeping track of two towels is obviously more difficult than handling one. Cross contamination will result as both sides of either towel are used (or moisture soaks through a towel) so that both sides of each towel become wet and transfer moisture to the hand during use.

An exercise shroud is described by Naughton in U.S. Pat. No. 5,491,843 which has one impervious surface and one absorbent surface, so that the shroud could be belted around one's waist during exercise with the impervious surface inward in contact with the user's clothing to prevent perspiration from the clothing penetrating into the shroud. While very effective for this purpose, the shroud cannot be used as a towel to wipe away perspiration from the user's body and wipe away moisture from exercise equipment surfaces without cross contaminating the absorbent side.

Thus, there is a continuing need for an improved towel arrangement that will allow a person exercising in an fitness center or the like to wipe perspiration from his or her body and wipe moisture, dirt, etc. from equipment surfaces without transferring the machine surface moisture to his or her body or contaminating both sides of the towel with both types of moisture.

SUMMARY OF THE INVENTION

The above noted problems, and others, are overcome by the towel system of this invention which basically consists of two approximately coextensive sheets (that is, having approximately the same area and configuration), each having an absorbent outer layer and a moisture impervious inner layer, with the two inner layers in a face to face relationship and secured together along a major portion of their contiguous edges. Preferably the edges are secured together in a manner leaving a sufficient unsecured edge portion to form a pocket into which the user may insert a hand.

The user may insert his or her hand with the palm along either of the two inner layers so that the corresponding outer layer can be used for wiping. Thus, one side can be used to wipe the user's body and the other to wipe equipment surfaces. Any suitable surface patterns may be formed on or applied to the towel. For example various indicia, designs or logos, different colors, different towel textures or materials, etc. could be used to identify the towel or to distinguish the two sides. The user's hand will never contact either moisture source and cross contamination between the two sides will be prevented.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
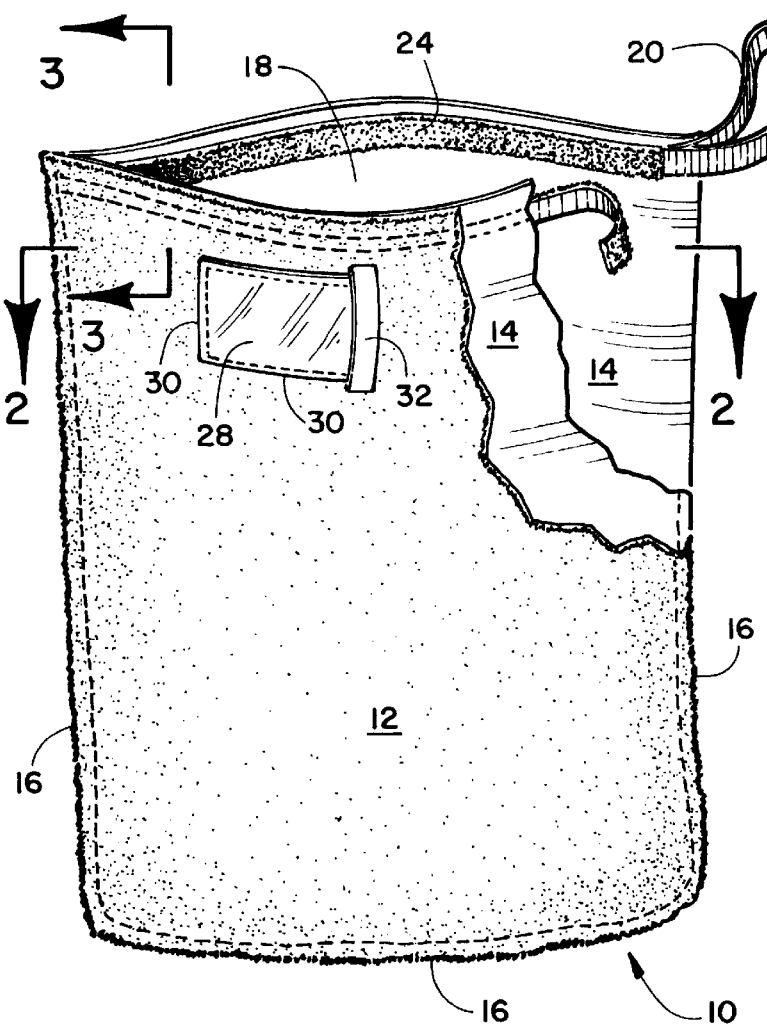
FIG. 1 is a perspective view of the two-sided towel of this invention.

Referring to the Figures, there is seen a towel 10 having, in the preferred embodiment shown, a generally rectangular configuration. Any other suitable shape may be used, as desired. The towel includes two sheets, each having an absorbent outer layer 12 and a moisture impervious inner layer 14. The inner and outer layers are fastened together along edges 16 and have an open end 18. While the two sheets are preferably coextensive, one could be somewhat larger than the other, so that side will bulge outwardly when the sheet edges are bonded together. The opening 18 preferably should have a length and arrangement such as to permit the towel to be turned inside out, so that after exercise and use of the towel the now-wet absorbent layer surfaces are inside and cannot contact clothing, car seats or the like when the towel is being carried away after an exercise session.

Any absorbent material may be used for outer layers 12, such as terry cloth, or cotton cloth. The two sides may be made from different material. For example, soft, thick, terry cloth is preferred for the side to be used in wiping perspiration from the body, while a rougher, harder material is preferred for the other side to clean moisture, dirt, etc. from equipment. Any suitable indica may be used to distinguish the two sides. Differences in texture may be used as such indicia, as well as different colors or different surface designs, etc.

Any suitable impervious material may be used for inner layers 14. A flexible plastic sheet material, such as vinyl or polyolefins such as polyethylene and polypropylene is preferred for inner layer 14. A bactericidal and a mildewicidal agent may be incorporated in the layers to prevent the growth of bacteria or mildew in the often damp materials. The impervious inner layers 14 may be separate from the absorbent outer layers 12, or may be bonded by heat or adhesive to the outer layer, or could simply be an impervious plastic material coated onto the inner side of the absorbent outer layers. A plastic material should be selected that is not damaged when towel 10 is washed in a conventional washing machine. Such materials include polyolefins and vinyls that resists temperatures up to about 212° F.

The inner and outer layers 12 and 14 may be secured together along closed edges 16 in any suitable manner. Typically, sewing, heat bonding and adhesive bonding may be used. Of these, sewing is preferred, for durability and convenience.

A loop 20 may be secured to towel 10 and may have any conventional clip attached thereto for securing car keys, fitness center badges, etc. to the towel. Any conventional clip 22 may be attached to loop 20 to hold key rings and the like.

Figure 3A:
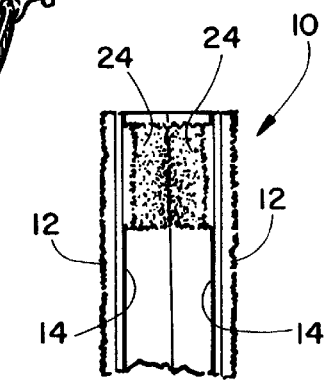
FIG. 3*a* is a detail section view taken on line 3—3 in FIG. 1 of a first fastening embodiment.

The towel may also function as a bag to carry selected items such as exercise clothing, books, wallets, etc. Any suitable fastener may be used to releasably close opening 18 to secure items within the towel. As seen in FIGS. 1 and 3*a*, strips of cooperating hook-and-loop material 24 of the sort available under the Velcro® fastener trademark may be secured to the inside edges of opening 18 to securely close the opening while allowing easy opening by pulling the opposing sides apart. Any other suitable fastener, such as snaps, a zipper, etc. may be used, if desired, although hook-and-loop material is preferred for simplicity, effectiveness and convenience.

Figure 3B:
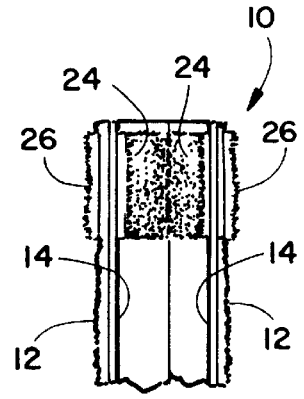
FIG. 3*b* is a detail section view taken on line 3—3 in FIG. 1 of a second fastening embodiment.

In some cases it will be preferable to carry towel 10 turned inside out. For example, after exercise, when the moisture absorbing outer layers 12 are damp and the user's exercise clothing is also damp, towel 10 can be turned inside out and the damp clothing carried within the towel, avoiding contaminating any surface or clothing that the towel might encounter with the retained moisture. In order to secure opening 18 closed when towel 10 is in this configuration, a fastener such as a strip 26 of hook or loop material may also be applied as shown to the outside edges of opening 18 as seen in detail view in FIG. 3*b*. When towel 10 is turned inside out, strips 26 will be facing each other and can be pressed together. While hook-and-loop material is preferred, snaps or any other suitable fastener may be used in place of strips 26.

Figure 2:
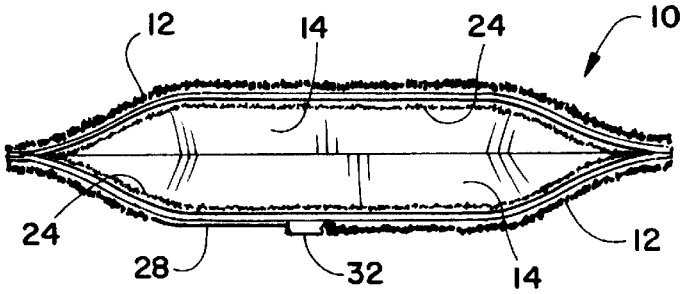
FIG. 2 is a section view taken on line 2—2 in FIG. 1.

As seen in FIGS. 1 and 2, a sleeve may be formed on either inner layer 14 or outer layer 12 by securing edges of a sheet 28 of transparent plastic, such as an acrylic, to the layer. Sheet 28 is secured to the towel around three edges 30 by an adhesive line, sewing, heat sealing or the like. A fitness center membership card, a business card or simply a card giving the owner's name and telephone number (in the event the towel is lost), etc. can be inserted under sheet 28. If desired, closure means, such as hook-and-loop material 32 of the sort described above may used to releasably close an open end of the sleeve.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

We claim:

1. A two-sided towel adapted to wiping moisture having different characteristics from two different surfaces, which comprises:

first and second sheets each having a moisture absorbent first layer and a moisture impervious second layer;

said first and second sheets being approximately coextensive;

said moisture impervious second layers positioned in face-to-face contact with edges abutting;

means securing said first and second sheets together along a predetermined portion of said edges to form a pocket shape with said moisture impervious second layers substantially entirely within said pocket;

said securing means omitted from a sufficient length of said edges to provide an opening through which a human hand can enter between said first and second sheets; and visible means for distinguishing said absorbent layer on said first sheet from said absorbent layer on said second sheet.

2. The two-sided towel according to claim 1 further including releasable closure means for closing said opening so that said towel may securely house predetermined objects.

3. The two-sided towel according to claim 2 wherein said closure means comprises cooperating strips of hook-and-loop material on said moisture impervious layer of said first and second sheets along said opening.

4. The two-sided towel according to claim 1 further including fastening means secured to at least one of said sheets for fastening objects to said moisture absorbent layer of said towel.

5. The two-sided towel according to claim 1 wherein said visible distinguishing means is selected from the group consisting of different colors, different surface patterns, different absorbent layer textures and combinations thereof.

6. The two-sided towel according to claim 1 wherein said opening is configured so as to permit said towel to be turned inside out whereby moist absorbent layers are within said towel.

7. The two-sided towel according to claim 6 further including additional closure means for closing said opening when said towel is inside out.

8. The two-sided towel according to claim 7 wherein said additional closure means comprises additional strips of cooperating hook-and-loop material on said moisture absorbent first layer along said opening to be brought into an operational relationship when said towel is inside out.

9. The two-sided towel according to claim 1 further including a transparent sheet having edges bonded to said moisture absorbent first layer and having an opening into which a card may be inserted, means adjacent to said opening for releasably closing said opening.

10. The two-sided towel according to claim 1 wherein said visible means for distinguishing said absorbent layer on said first sheet from said absorbent layer on said second sheet is selected from the group consisting of different colors, different materials, different textures, different surface designs and combinations thereof.

11. A two-sided towel adapted to wiping moisture from two different surfaces which comprises:

first and second sheets each having a moisture absorbent first layer and a moisture impervious second layer;

said first and second sheets being approximately coextensive;

said moisture impervious second surfaces positioned in face-to-face contact with edges abutting;

means securing said first and second sheets together along a predetermined portion of said edges to form a pocket shape;

said securing means omitted from a sufficient length of said edges to provide an opening through which a human hand can enter between said first and second sheets;

said opening configured to permit said towel to be turned inside out;

a first releasable closure means on said first layer adjacent to edges of said opening for closing said opening so that said towel may securely house objects;

a second releasable closure means on said second layer adjacent to edges of said opening for closing said opening when said towel is turned inside out so that said towel may securely house objects; and visible means for distinguishing said absorbent layer on said first sheet from said absorbent layer on said second sheet.

12. The two-sided towel according to claim 11 wherein each of said closure means comprises cooperating strips of hook-and-loop material.

13. The two-sided towel according to claim 11 further including fastening means secured to at least one of said sheets for fastening objects to said moisture absorbent layer of said towel.

14. The two-sided towel according to claim 11 wherein said visible distinguishing means is selected from the group consisting of different colors, different surface patterns, different absorbent layer textures and combinations thereof.

15. The two-sided towel according to claim 11 further including a transparent sheet having edges bonded to said moisture absorbent first layer and having an opening into which a card may be inserted, said opening including means for releasably closing said opening.

16. The two-sided towel according to claim 11 wherein said visible means for distinguishing said absorbent layer on said first sheet from said absorbent layer on said second sheet is selected from the group consisting of different colors, different materials, different textures, different surface designs and combinations thereof.

* * * * *